United States Patent [19]

Tanaka et al.

[11] 4,149,531

[45] Apr. 17, 1979

[54] ROLLER-TYPE MASSAGER

[75] Inventors: Yuugi Tanaka; Katsutoshi Toyoshima, both of Tokyo, Japan

[73] Assignee: Marutaka Iryoki Co., Ltd., Tokyo, Japan

[21] Appl. No.: 846,504

[22] Filed: Oct. 26, 1977

[30] Foreign Application Priority Data

Dec. 28, 1976 [JP] Japan ..... 51-157602

[51] Int. Cl.[2] ..... A61H 7/00; A61H 15/00

[52] U.S. Cl. ..... 128/52; 128/57

[58] Field of Search ..... 128/52, 57, 24.3, 33

[56] References Cited

U.S. PATENT DOCUMENTS

| | | | |
|---|---|---|---|
| 1,645,339 | 10/1927 | Monroe | 128/57 |
| 1,817,077 | 8/1931 | Gustaveson | 128/57 |
| 3,003,497 | 10/1961 | Nunes | 128/57 |
| 3,039,458 | 6/1962 | Hill | 128/52 |
| 3,640,272 | 2/1972 | Hussey | 128/33 |
| 3,709,047 | 1/1973 | Zaruba et al. | 128/57 X |
| 3,882,856 | 5/1975 | Heuser et al. | 128/24.3 X |

FOREIGN PATENT DOCUMENTS

| | | | |
|---|---|---|---|
| 441661 | 11/1948 | Italy | 128/57 |

*Primary Examiner*—Lawrence W. Trapp

*Attorney, Agent, or Firm*—Wenderoth, Lind & Ponack

[57] ABSTRACT

A roller-type massager having a pair of massage rollers rotatably mounted on a horizontal axle in parallel and spaced from each other within a chair back are vertically reciprocated along the spinal column. The horizontal axle is mounted on a screw housing and supported at both ends by a pair of guide rollers which are guided along a pair of vertical rails fixedly mounted within the chair back. The screw housing has a vertical through female screw threadably connecting with a vertical elongated screw bar which is rotatably mounted between the vertical rails and driven by a motor through a V-belt and pulleys transmission.

1 Claim, 3 Drawing Figures

ROLLER-TYPE MASSAGER

BACKGROUND OF THE INVENTION

The present invention relates to a roller-type massager for massaging the user's back parallel with the spinal column, and the massager comprises at least one massage roller movably mounted in a chair back and driven vertically along the spinal column by a motor.

It has been demonstrated by a large number of experiments that massage, as a remedial treatment, is very effective in various ailments. Since the spinal column is the trunk line from which a large number of nerves branch out to various organs, it is the seat of various ailments, and certain schools of healing have developed a system of treatment directed to the rectification of spinal defects, which, in turn, relieves pressure on the nerves and improves the functioning of the organs.

DESCRIPTION OF THE PRIOR ART

Heretofore, conventionally, massage rollers has been built in a bed and the user has been massaged on the bed wherein the massage rollers are driven reciprocally along the user's spinal column. However, this bed-type massager is expensive and takes up much space.

When the user wants to massage his own back along the spinal column, preferrably, both sides adjacent to the spinal column, it is most preferrable to sit in a reclining chair and lean against the chair back wherein massage rollers are movably built in, because, in such a chair-type massager, it is easier to lie down or get up than it is with the bed-type massager. Furthermore, in terms of cost and space, the chair-type massager is superior to the bed-type massager.

In realizing such chair-type massager, since the chair back space is excessively narrower than the bed space, the roller assembly and its driving mechanism should be made drastically compact. However, this is extremely difficult and it is for this reason that commercially available chair-type massagers having massage rollers moving vertically within the chair back along the spinal column are normally not utilized.

SUMMARY OF THE INVENTION

In view of the foregoing state of the art, it is an object of the present invention to provide a roller-type massager having massage rollers movably built in a chair back, and particularly, to provide a compact roller assembly and a compact driving mechanism, to thereby massage reciprocally the user's back adjacent the spinal column through the chair back cover.

Briefly stated, the massager in accordance with the present invention achieves the above objective by providing a pair of parallel massage rollers rotatably mounted on a horizontal axle and spaced from each other through a screw housing within a chair back. The massage rollers are vertically reciprocated along the user's spinal column and massage the back adjacent to the spinal column. The horizontal axle is mounted on the screw housing and supported at both ends by a pair of guide rollers which are guided along a pair of vertical elongated guide rails fixedly mounted within the chair back. The screw housing is provided with a vertical through-female screw threadably connecting with a vertical elongated screw bar which is rotatably mounted between the guide rails and driven by a motor through a V-belt and pulleys transmission.

BRIEF DESCRIPTION OF THE DRAWINGS

Further objects and a better understanding of the present invention will be more apparent from the following description taken with the drawings wherein.

DESCRIPTION OF THE PREFERRED EMBODIMENT

Figure 1:
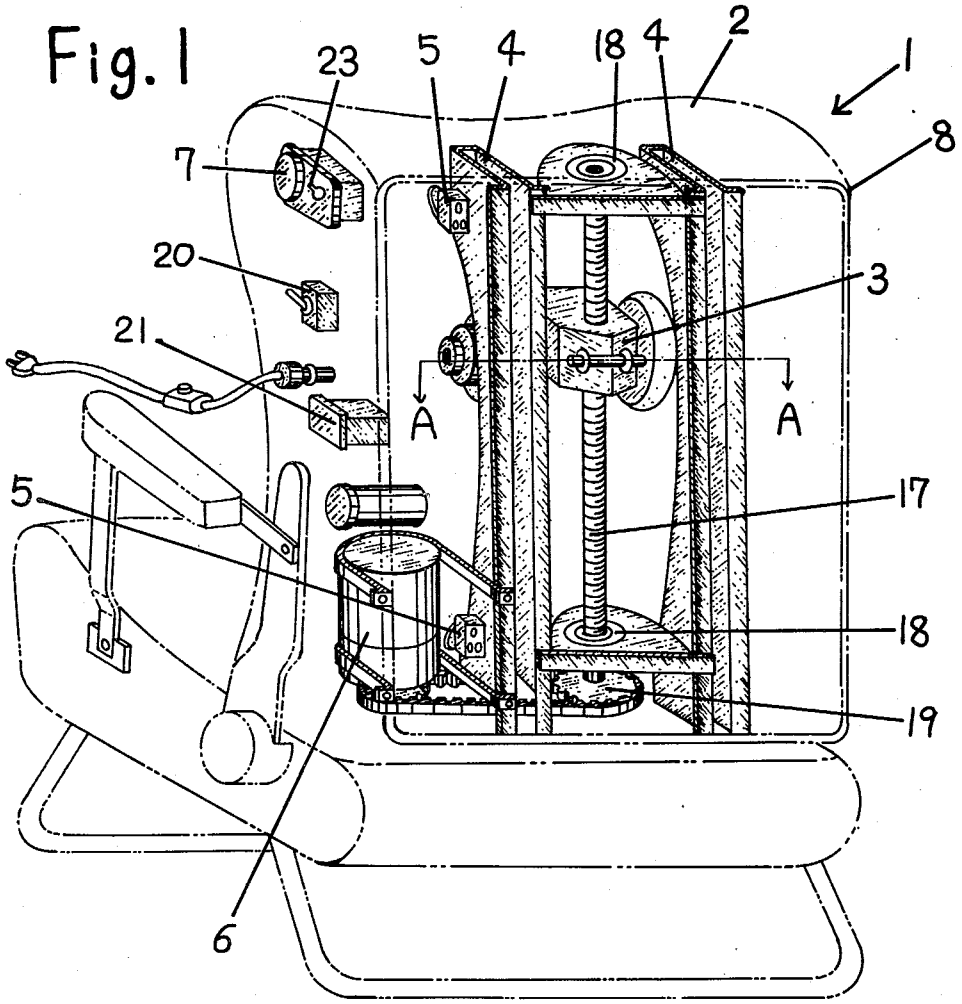
FIG. 1 is a perspective view of the roller-type massager having a pair of massage rollers movably mounted in the chair back.

Referring now to the drawings for detailed description of the present invention wherein like reference numerals identify like parts, FIG. 1 discloses a roller-type massager of a novel chair-type in accordance with the present invention.

The massager is characterized by the provisions of a pair of massage rollers 10, a pair of guide rollers 15, a pair of guide rails 4, and a speed reduction means (a screw housing 3 and a vertical elongated bar 17.).

Figure 2:
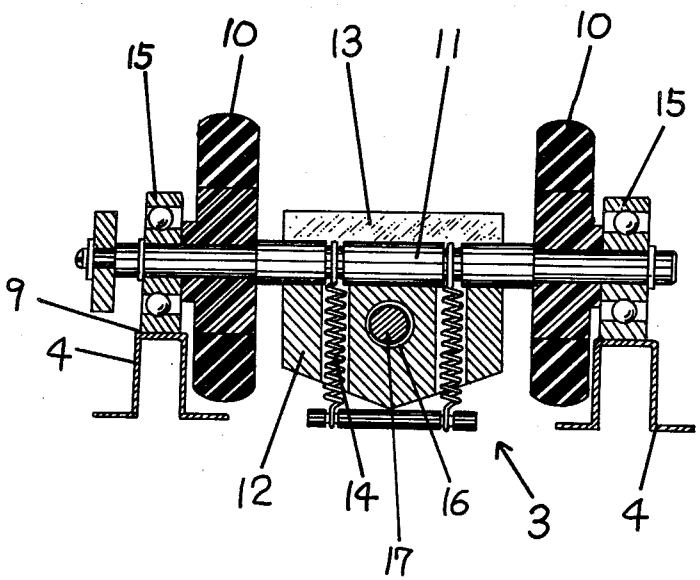
FIG. 2 is a cross-sectional view of the roller assembly, which is taken along the line A—A of FIG. 1.

As shown in FIG. 1, the guide rails 4 are fixedly, vertically mounted in parallel with each other within a frame 8 forming a chair back 2 of a reclining chair 1. Between the rails 4 is a roller assembly 3 which is, as shown in FIG. 2, provided with a pair of massage rollers 10 of resilient material such as rubber, a horizontal axle 11 carrying at its both ends the massage rollers 10, and a screw housing 12 between the massage rollers 10. The screw housing 12 is provided with a groove 13 in which the horizontal axle 11 is resiliently held by a pair of coil springs 14. At the outer sides of the massage rollers 10 are a pair of guide rollers 15 which rotatably contact the guide surfaces 9 of the guide rollers 15 and are driven reciprocally along the rails 4.

The screw housing 12 has a vertical through-female screw 16 which connects threadably with a vertical screw bar 17. The bar 17 is rotably mounted along the rails 4 within the frame 8 and is driven by a motor 6 for driving the roller assembly reciprocatively. Both end portions of the screw bar 17 are rotatably received in the bearings 18 which are fixedly mounted on the rails 4. At the lower end of the screw bar 17 is a pulley 19 which connects with the motor 6 through a V-belt. At both the lower and upper ends of the rails 4 are a pair of limit switches 5 which are activated by the contact with the roller assembly3 and which change the rotational direction of the motor 6.

Figure 3:
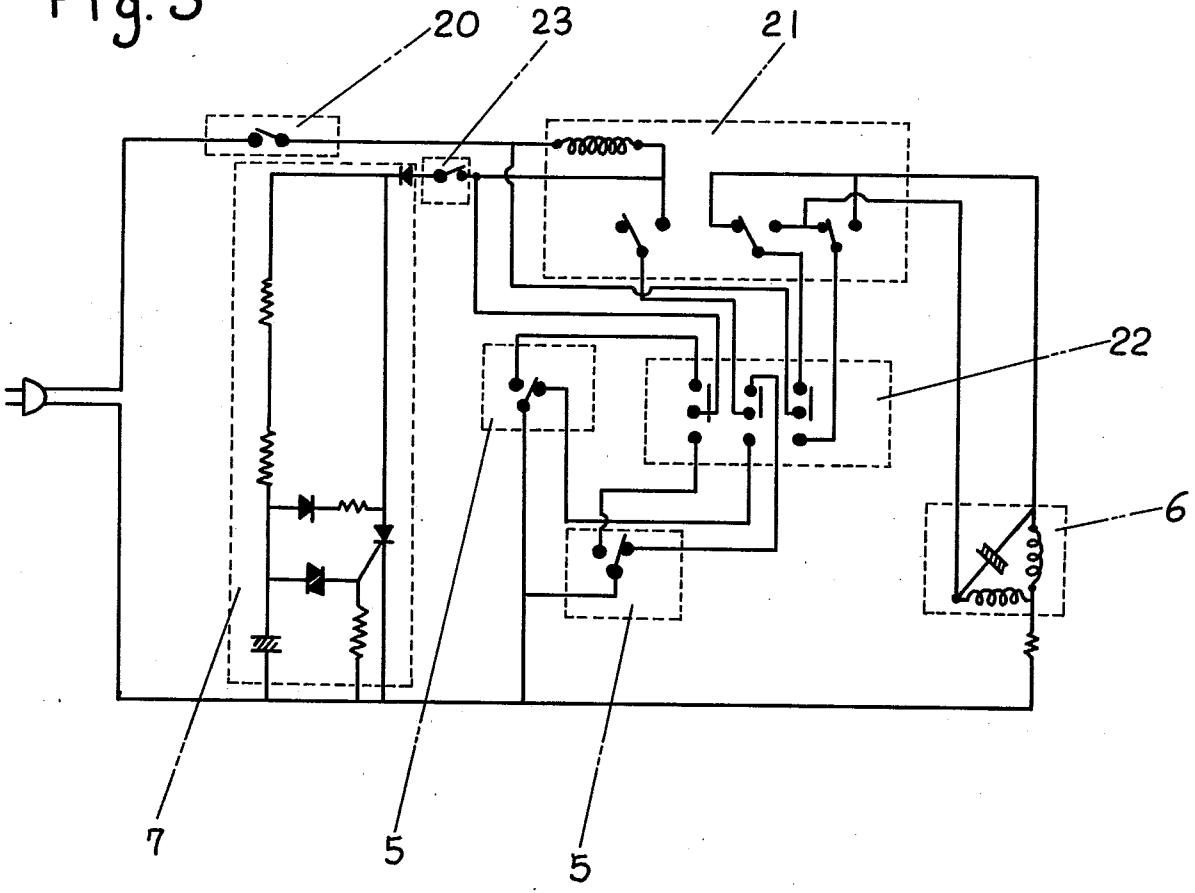
FIG. 3 is a block diagram of the preferred electrical components of the roller-type massager.

In this embodiment, as shown in FIG. 3, the circuit for driving the motor 6 is provided with a timer 7 which controls the reciprocating positions of the roller assembly 3. In this circuit, the supply line from a power switch 20 is connected to an electromagnetic relay 21 and a triple switch 22. An output from the triple switch 22 is supplied to the motor 6 through the relay 21 and the limit switches 5. An output from the relay 21 is supplied to the timer 7 through a switch 23.

Therefore, when the switch 23 is at "OFF", both limit switches 5 are set in force and thereby the roller assembly 3 is reciprocated throughout the whole length of the rails 4. When the switch 23 is at "ON", the roller-assembly 3 is reciprocated in the upper portion or the lower portion of the rails 4 by selecting the triple switch 22. In the former, the upper limit switch 5 and the timer 7 control the reciprocation of the roller assembly 3, and in the latter the lower limit switch 5 and the timer 7 control the reciprocation of the rollor assembly 3.

Since the timer 7 controls the reciprocation of the assembly 3 by a preset period of time, it is possible to arrange the reciprocation position and distance of the roller assembly 3 in various manners based on the upper or the lower limit position at which the limit switch 5 is activated. Therefore, the roller-type massager of the present invention can easily massage any back of the user selectively.

While the present invention has been described with reference to specific embodiment thereof, it should be understood that various other embodiments and modifications, all within the true spirit and scope of the present invention, may be developed by those skilled in the art.

What is claimed is:

1. A roller-type massager built into a chair back comprising; a pair of guide rails fixedly mounted within said chair back, an elongated screw bar rotatably mounted along said guide rails, a motor rotatably driving said screw bar, a screw housing having a through-female screw threadably connecting with said screw bar and thereby driven along said screw bar, a horizontal axle mounted on said screw housing, a pair of massage rollers rotatably carried by said horizontal axle, and a pair of guide rollers rotatably carried by said horizontal axle and contacting said guide rails for supporting said massage rollers against the outer pressure caused by massage action.

* * * * *